US007743852B2

(12) United States Patent
Paskar

(10) Patent No.: US 7,743,852 B2
(45) Date of Patent: Jun. 29, 2010

(54) AUGER STABILIZER

(76) Inventor: Stanley M. Paskar, 104, 2916 - 105A Street NW, Edmonton, AB (CA) T6J 4J4

( * ) Notice: Subject to any disclaimer, the term of this patent is extended or adjusted under 35 U.S.C. 154(b) by 0 days.

(21) Appl. No.: 12/210,972

(22) Filed: Sep. 15, 2008

(65) Prior Publication Data

US 2009/0008153 A1 Jan. 8, 2009

Related U.S. Application Data

(63) Continuation-in-part of application No. 11/861,173, filed on Sep. 25, 2007.

(30) Foreign Application Priority Data

Sep. 28, 2006 (CA) ..... 2561421

(51) Int. Cl.
*E21B 1/02* (2006.01)

(52) U.S. Cl. ..... 175/121; 175/170; 173/185

(58) Field of Classification Search ..... 175/121, 175/170, 189, 202, 203; 173/31, 185
See application file for complete search history.

(56) References Cited

U.S. PATENT DOCUMENTS

| | | | | |
|---|---|---|---|---|
| 1,470,838 | A | 10/1923 | Holmes | |
| 2,217,300 | A | 10/1940 | Templeton | |
| 2,320,775 | A | 6/1943 | Garner | |
| 2,505,331 | A | 4/1950 | Lambly | |
| 2,562,276 | A | 7/1951 | Kandle | |
| 2,604,304 | A | 7/1952 | Wilson | |
| 2,734,722 | A | 2/1956 | Pokorny | |
| 2,815,049 | A | 12/1957 | Herscovitch | |
| 2,856,156 | A | 10/1958 | Young | |
| 3,429,386 | A | 2/1969 | Secrist | |
| 3,976,147 | A | 8/1976 | Cunningham | |
| 4,077,480 | A | 3/1978 | Carlson | |
| 4,116,284 | A | 9/1978 | Cox | |
| 4,155,527 | A * | 5/1979 | Sjoberg | 248/647 |
| 4,961,471 | A | 10/1990 | Ovens | |
| 4,979,578 | A | 12/1990 | Landry | |
| 4,998,590 | A | 3/1991 | Wells | |
| 5,007,492 | A | 4/1991 | Giroux | |
| 5,388,654 | A | 2/1995 | Heiss | |

(Continued)

FOREIGN PATENT DOCUMENTS

| | | |
|---|---|---|
| CA | 717736 | 9/1965 |

(Continued)

*Primary Examiner*—William P Neuder
(74) *Attorney, Agent, or Firm*—Christensen O'Connor Johnson Kindness PLLC

(57) ABSTRACT

An auger stabilizer includes a rigid elongated body having a first end and a second end. The length of the body is adjustable between a retracted transport position and an extended drilling position. A pair of spaced apart wheels are attached at the second end of the body. A split body with two halves connected by fasteners is used to pivotally attach the first end of the body to a handle of an auger. When the body is in the extended drilling position, the pair of spaced apart wheels roll along a ground surface away from the auger as the handle of the auger descends and the pair of spaced apart wheels act to stabilize the handle of the auger against reactive torque.

20 Claims, 7 Drawing Sheets

U.S. PATENT DOCUMENTS

| | | | | |
|---|---|---|---|---|
| 5,396,967 | A | 3/1995 | Stewart | |
| 5,507,354 | A | 4/1996 | Harleman | |
| 5,868,211 | A | 2/1999 | Bohn | |
| 6,056,065 | A | 5/2000 | Campbell | |
| 6,315,059 | B1 | 11/2001 | Geldean | |
| 6,419,245 | B1 | 7/2002 | Trimble | |
| 6,539,676 | B2 | 4/2003 | Price | |
| 6,889,779 | B2 | 5/2005 | Skarlupka, IV | |
| 7,178,615 | B1 * | 2/2007 | Smollock et al. | 180/19.1 |

FOREIGN PATENT DOCUMENTS

| | | | |
|---|---|---|---|
| CA | 2298051 | A1 | 8/2000 |
| FR | 2733002 | A3 | 10/1996 |

* cited by examiner

AUGER STABILIZER

FIELD

The present application relates to a stabilizer for an auger, specifically, an auger used for drilling post holes and the like.

BACKGROUND

Augers are commonly used to dig holes, such as for posts. These augers have a gas powered engine that drives a depending auger screw. Handles are provided to allow either one or two people to operate it. A problem often encountered is reactive torque. U.S. Pat. No. 5,007,492 teaches a safety stabilizer to help counteract the twisting motion on the handles caused by reactive torque.

SUMMARY

There is provided an auger stabilizer which includes a rigid elongated body having a first end and a second end. The length of the body is adjustable between a retracted transport position and an extended drilling position. A pair of spaced apart wheels are attached at the second end of the body. Means are provided for pivotally attaching the first end of the body to a handle of an auger. When the body is in the extended drilling position, the pair of spaced apart wheels roll along a ground surface away from the auger as the handle of the auger descends and the pair of spaced apart wheels act to stabilize the handle of the auger against reactive torque.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
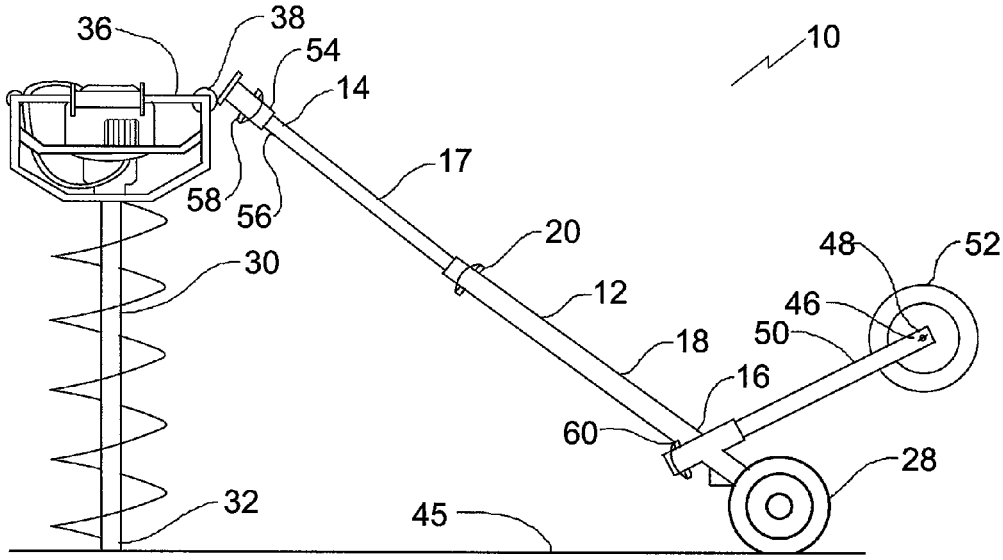
FIG. 1 is a side plan view of the auger stabilizer in the extended drilling position.

An auger stabilizer generally identified by reference numeral 10, will now be described with reference to FIG. 1 through 9. A variation generally identified by reference numeral 100 will be described with reference to FIG. 10 through 12.

Figure 3:
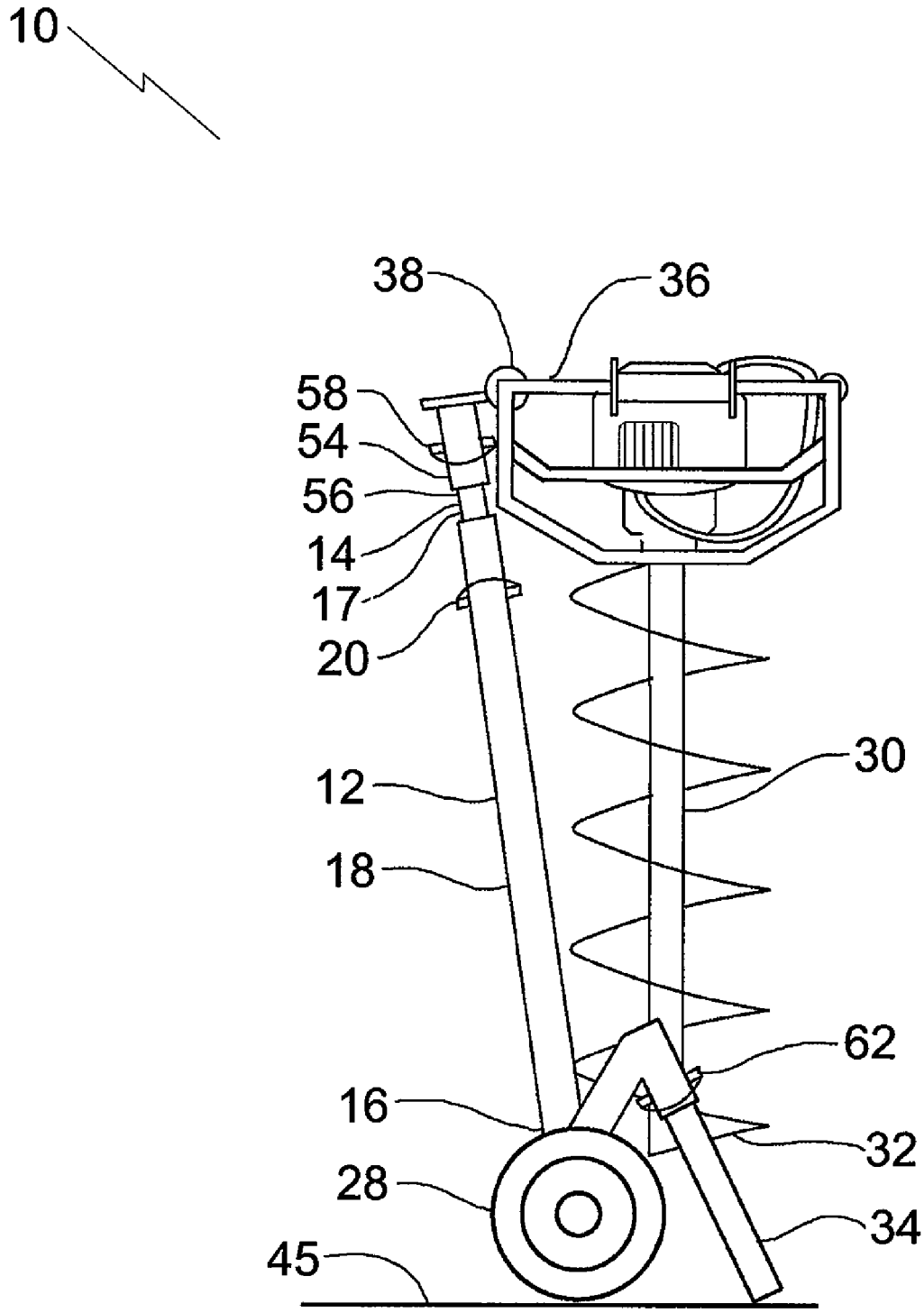
FIG. 3 is a side plan view of the auger stabilizer in the retracted transport position and in an upright orientation.
Figure 4:
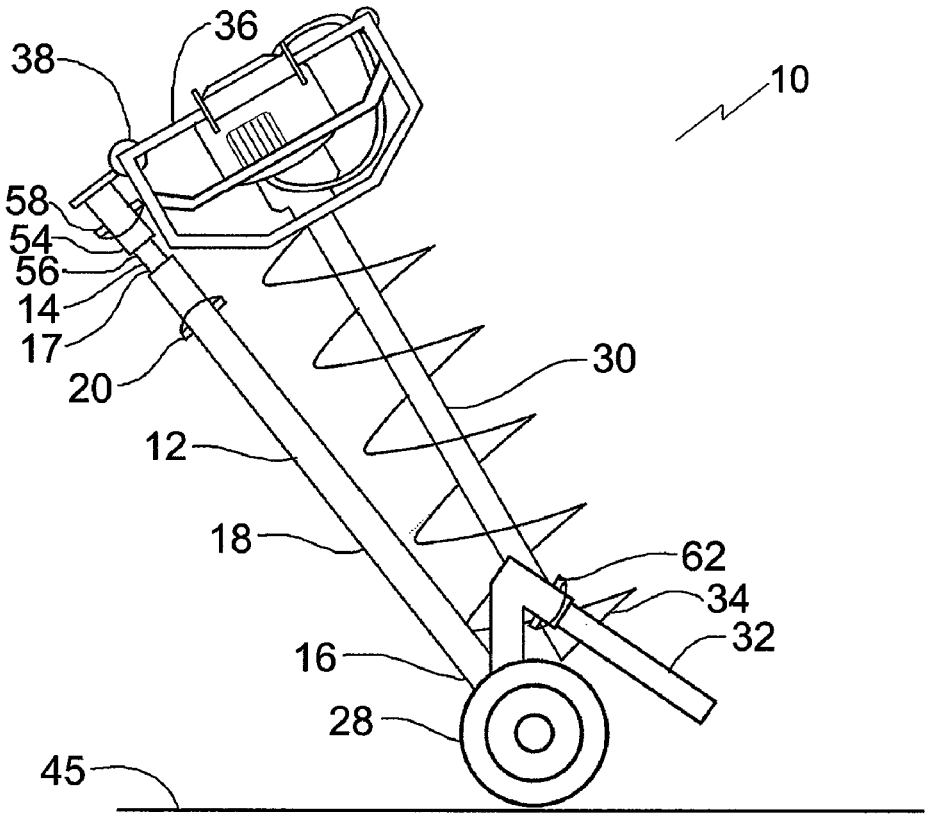
FIG. 4 is a side plan view of the auger stabilizer of FIG. 1 in the retracted transport position and in a reclined position.
Figure 6:
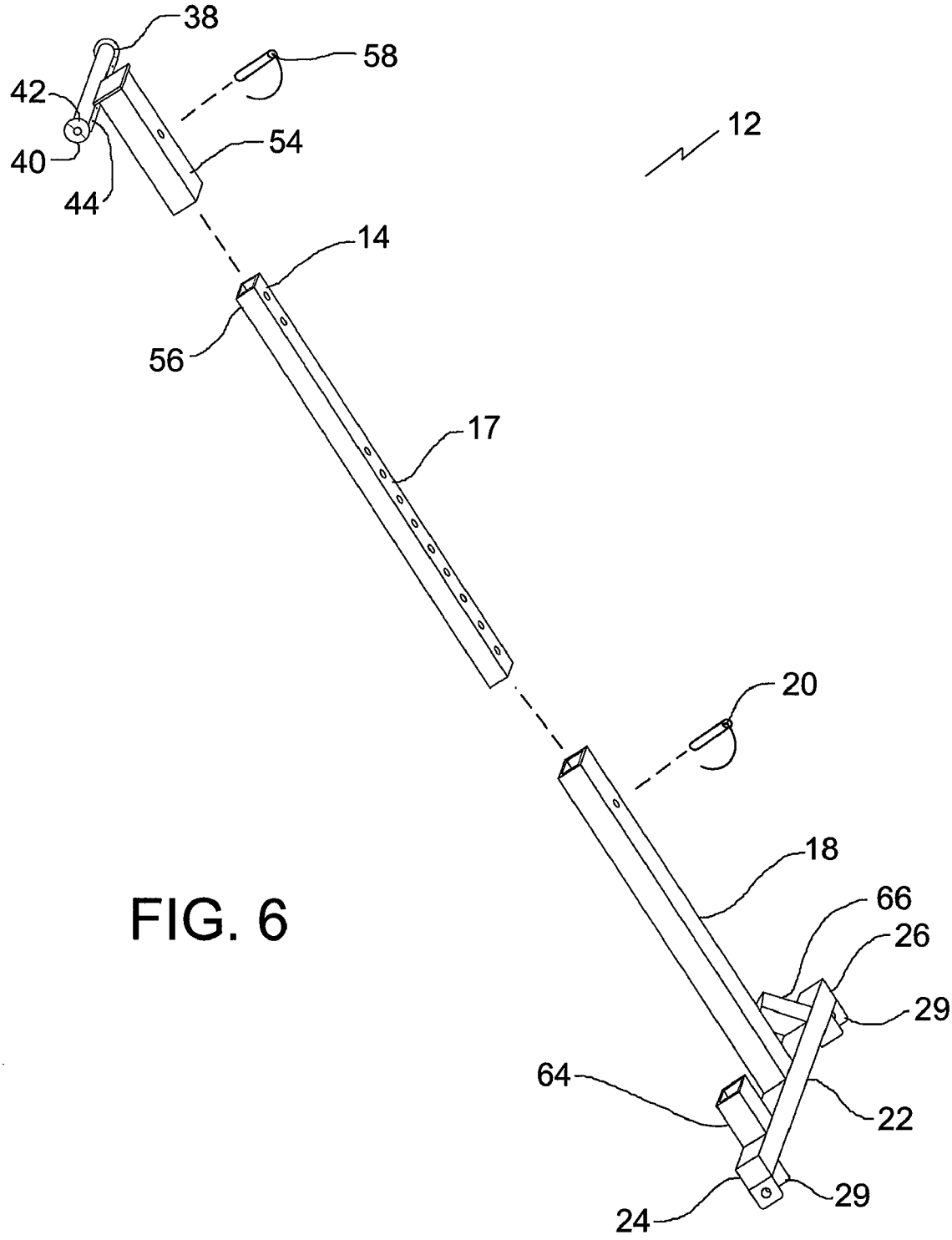
FIG. 6 is an exploded perspective view of the body of the auger stabilizer.
Figure 7:
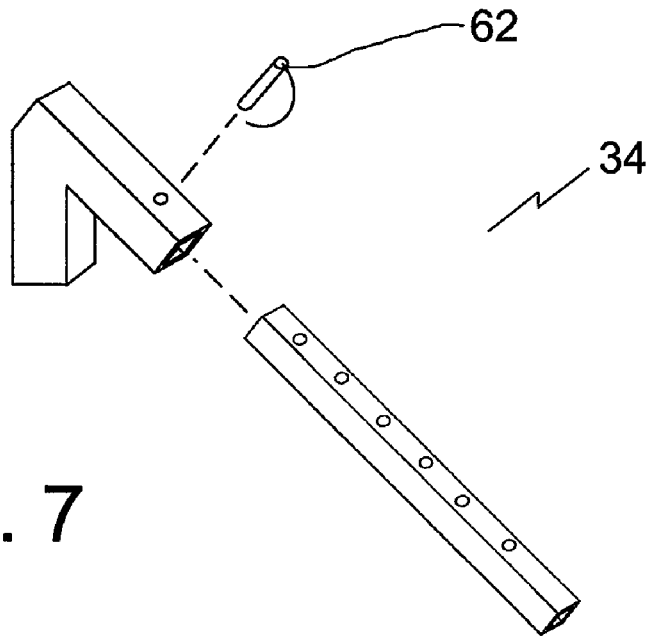
FIG. 7 is an exploded perspective view of the support stand.
Figure 8:
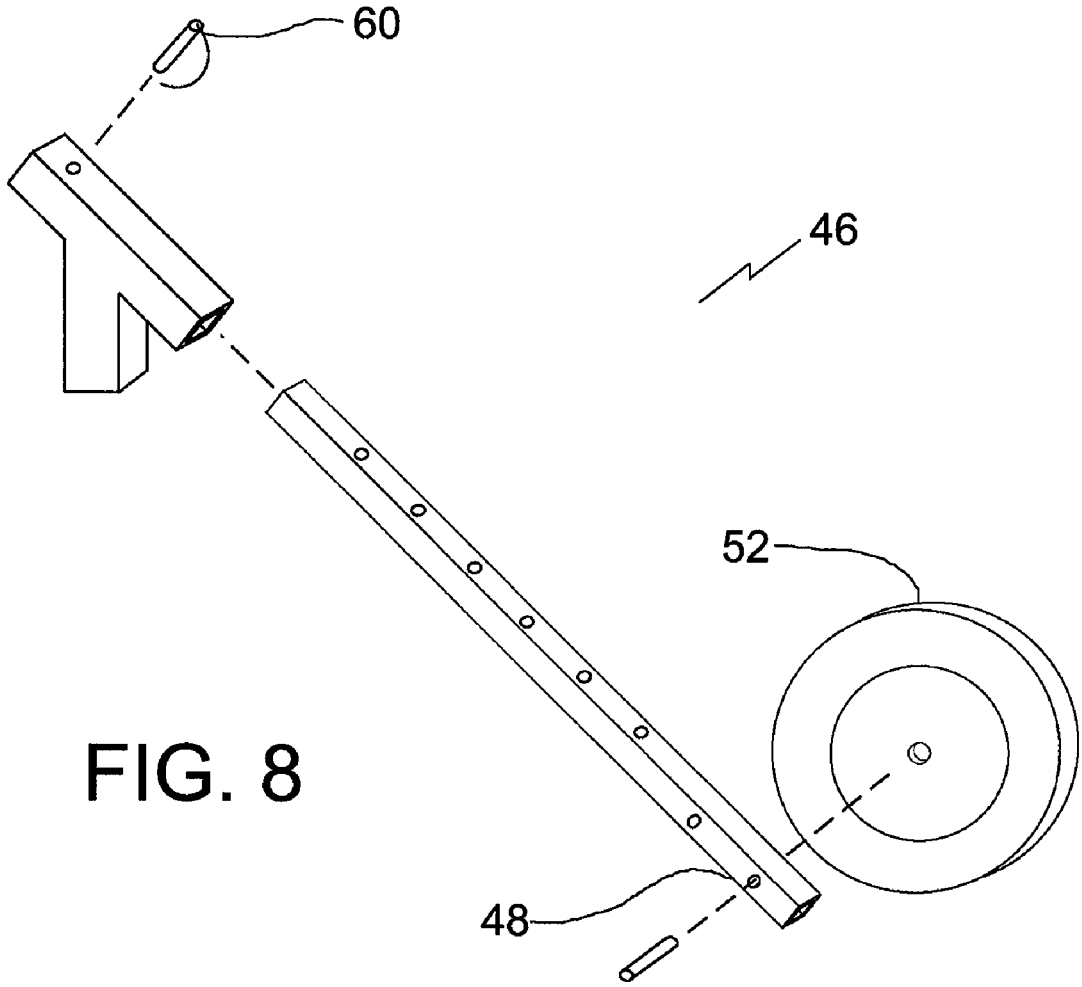
FIG. 8 is an exploded perspective view of the counterweight and counterweight mounting.
Figure 9:
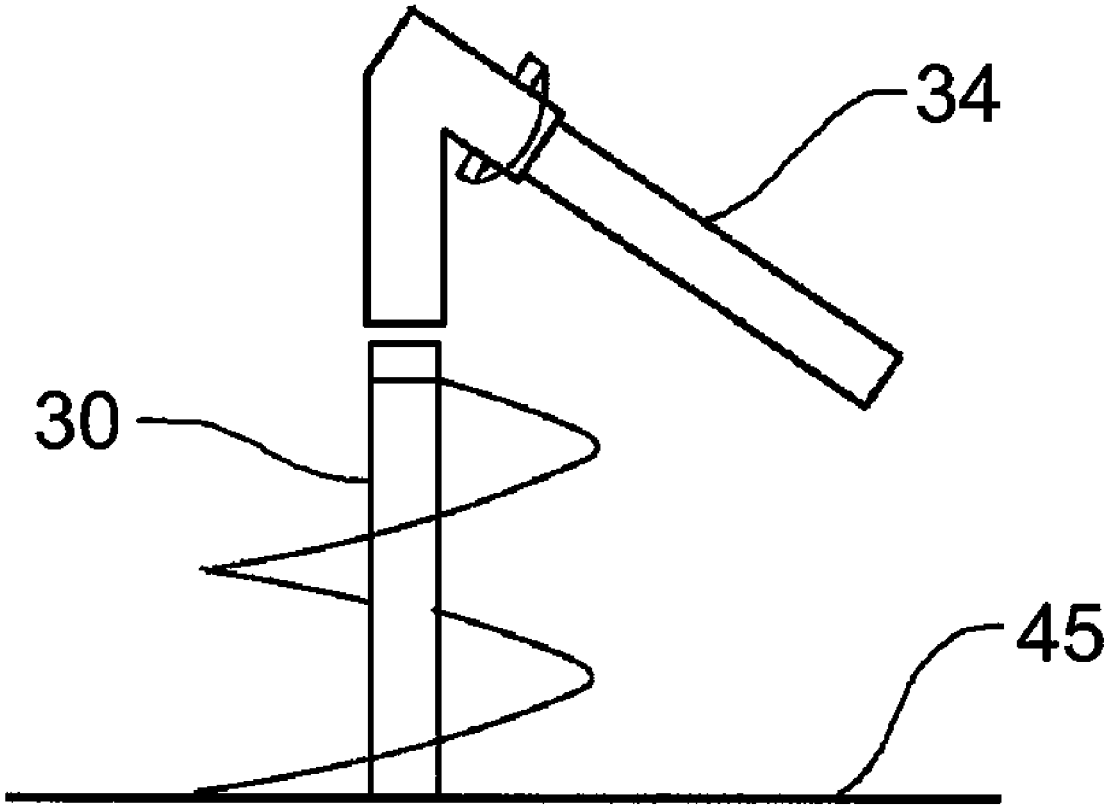
FIG. 9 is an exploded side elevation view of the support stand being used to remove the auger from the ground.

Structure and Relationship of Parts:

Referring to FIG. 1, auger stabilizer 10 includes a rigid elongated body 12 having a first end 14 and a second end 16. The length of body 12 is adjustable between a retracted transport position shown in FIG. 3 and an extended drilling position shown in FIG. 1. Referring to FIG. 6, this may be done by providing a first tubular member 17 and a second tubular member 18 that are telescopically mated. A removable pin connection 20 is provided for fixing first tubular member 17 and second tubular member 18 in a selected telescopic position. It will be understood that other means known to those skilled in the art may be used to make the length of body 12 adjustable and to fix their position. A cross bar 22 is transversely positioned at second end 16 of body 12 having opposed ends 24 and 26. Wheel mounts 29 are provided at each of opposed ends 24 and 26 of cross bar 22. Referring to FIG. 1, a pair of are spaced apart wheels 28 may then be mounted to body 12. Referring to FIGS. 4 and 6, when reclined for use as a dolly, cross bar 22 engages a ground piercing end 32 of auger 30 to serve as a pivotal stop. Referring to FIG. 3, to allow auger 30 to remain upright when not being transported and when not drilling, a support stand 34 is mounted on cross bar 22 at second end 16 of body 12. Support stand 34 is designed to support body 12 and auger 30 in a substantially vertical orientation when body 12 is in the retracted transport position.

Figure 2:
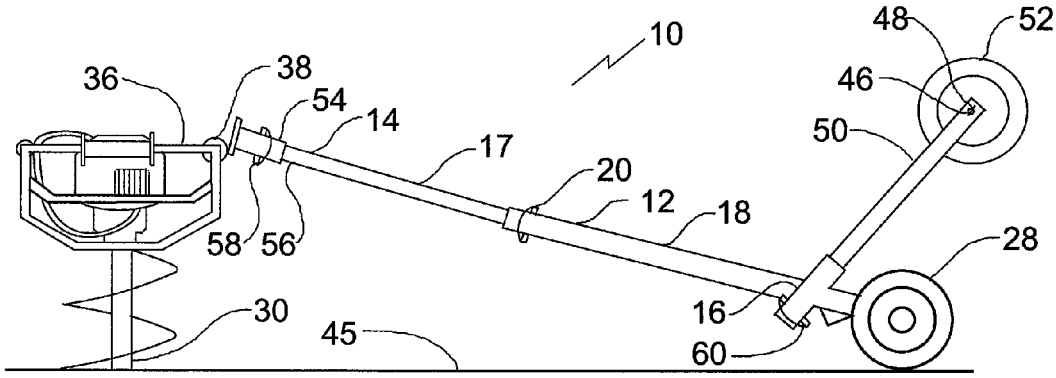
FIG. 2 is a side plan view of the auger stabilizer in the extended drilling position with the auger drilling a hole.
Figure 5:
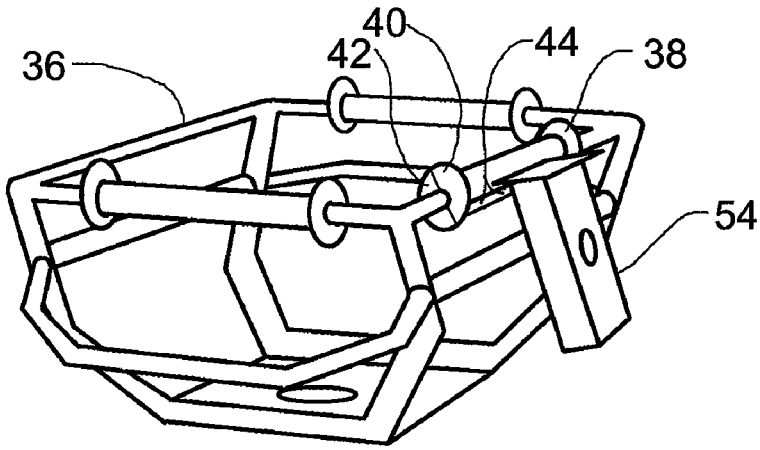
FIG. 5 is a detailed perspective view of the pivotal attachment of the auger stabilizer to the handle of the auger

Referring to FIG. 5, first end 14 of body 12 is pivotally attached to the handle 36 of auger 30. As depicted, this is done by providing a split body 38 having two halves 40 and 42 that are positioned around handle 36 and then secured together with fasteners 44. Thus, body 12 is able to rotate with respect to auger 30 between the extended drilling position shown in FIG. 1 and the retracted transport position shown in FIG. 3. In the retracted transport position, body 12 may be reclined to be used as a dolly as shown in FIG. 4 such that cross bar 22 engages ground piercing end 32 as described above. When in this position, wheels 28 allow body 12 to act as a dolly to transport auger 30. Referring to FIGS. 1 and 2, in the extended drilling position, wheels 28 roll along a ground surface 45 away from auger 30 as handle 36 of auger 30 descends. As this occurs, wheels 28 act to stabilize handle 36 of auger 30 against reactive torque. A counterweight mounting 46 is positioned at second end 16 of body 12. As depicted, counterweight mounting 46 is positioned at a remote end 48 of a cantilever arm 50. One or more counterweights 52 is then mounted on counterweight mounting 46 to provide additional mass acting upon wheels 28. This helps further stabilize handle 36 against reactive torque, and also allows the user to lift auger 30 using less force.

In order to allow for more flexible use, some attachments are releasable. For example, referring to FIG. 5, split body 38 has a depending female coupling 54 adapted to mate with first end 14 of body 12, which serves as a male coupling 56. A pin connection 58 is provided to prevent male coupling 56 from being accidentally withdrawn from female coupling 54. Body 12 is thus selectively detachable from female coupling 54 and thus auger 30 by removing pin connection 58. In addition, referring to FIGS. 7 and 8, cantilever arm 50 and support stand 34 use similar pin connections 60 and 62, respectively. Referring to FIG. 6, cross bar 22 also has mounting 64 and 66 to support cantilever arm 50 and support stand 34, respectively, such that either may be removed so as not to impede the use of body 12 and auger 30. Body 12 is designed such that cantilever arm 50 and support stand 34 extend in opposite directions from cross bar 22. In addition, referring to FIG. 9, it may be necessary to remove the top portion of auger 30 from the auger screw if auger 30 becomes stuck. A bar is then be used as a wrench to turn auger 30 to remove it from the ground. Support stand 34 may be designed such that it can be used as a bar for that purpose.

Operation:

The use of auger stabilizer 10 described above in relation to FIG. 1 through 8 will now be discussed. Referring to FIG. 5, split body 38 is attached to handle 36 of auger 30 by placing first half 40 and second half 42 about handle 36, and securing it using fasteners 44 to as a pivotal connection. Body 12 is then attached to split body 38 and thus handle 36 of auger 30 by engaging male coupling 56 and female coupling 54, and securing them with pin connection 58. As pin connection 58 is removable, it is unnecessary to remove split body 38 once attached, if it is preferable to use auger 30 without body 12. Referring to FIG. 3, body 12 is shown in the retracted transport position. Support stand 34 allows auger 30 and body 12 to remain in a substantially vertical position. Referring to FIG. 4, body 12 may be reclined such that support stand 34 no longer engages ground surface 45, and ground piercing end 32 of auger 30 is supported by cross bar 22. Body 12 thus acts as a dolly such that auger 30 may be moved to the desired location on wheels 28. When auger 30 is correctly positioned, support stand 34 is removed, and counterweight mounting 46 is attached to body 12 as shown in FIG. 1. Body 12 is then extended by telescopically extending first tubular member 17 and second tubular member 18, and using pin connection 20 to fix them in the selected telescopic position. Auger 30 may then be operated to dig a hole in ground surface 45. Referring to FIG. 2, as auger 30 and handle 36 descend, wheels 28 allow second end 16 of body 12 to move further away from auger 30, with counterweight 52 providing additional weight on wheels 28. This helps to stabilize auger 30 from any reactive torque that may be applied during drilling. Counterweight 52 also acts to reduce the amount of force necessary to lift auger from the hole. Referring to FIG. 1, auger 30 may then be raised, and repositioned to drill another hole. When the drilling is completed, body 12 is returned to the retracted position shown in FIG. 3, counterweight 52 is replaced with support stand 34, and body 12 may again be used as a dolly as shown in FIG. 4.

Figure 10:
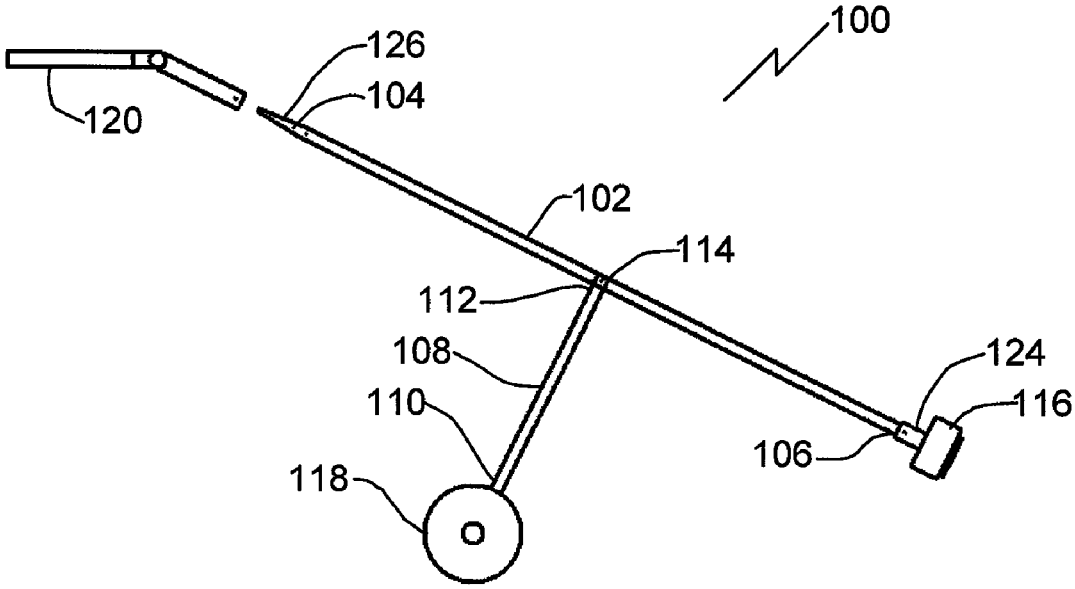
FIG. 10 is a partially exploded side elevation view of an alternative auger stabilizer.
Figure 11:
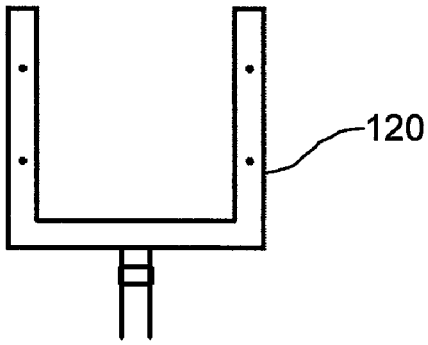
FIG. 11 is a detailed top plan view of an alternative auger clamp.

Variation:

Referring to FIG. 10, alternative auger stabilizer 100 is shown. A first rigid elongated body 102 has a first end 104 and a second end 106. A second rigid elongated body 108 has a first end 110 and a second end 112. Second body 108 is connected to first body 102 at a point 114 intermediate first end 104 and second end 106 of first body 102 such that first end 110 extends outward from first body 102. A counterweight 116 is positioned toward second end 106 of first body 102 relative to intermediate point 114 to offset the weight of the auger. The actual weight of the counterweight 116 may be adjustable, and will depend on the weight of the auger, the location of intermediate point 114, and the length of second body 108. A pair of spaced apart wheels 118 is attached at first end 110 of second body 108. Referring to FIG. 11, there is also a handle clamp 120, or other means for pivotally attaching first end 104 of first body 102 to an auger (not shown), such that when first end 104 of body 102 descends, wheels 118 roll along a ground surface away from the auger. Wheels 118 thus act to stabilize the handle of the auger against reactive torque. It will be understood that handle clamp 120 may take various forms, depending on the type of auger handle it is intended to be attached to, or it may take a for that is universally connectable to various types of handles. However, it is important that the clamp or other attachment provide sufficient support to withstand against any reactive torque, and also to allow first body 102 to act as a lever to screw out the auger if it becomes stuck.

Figure 12:
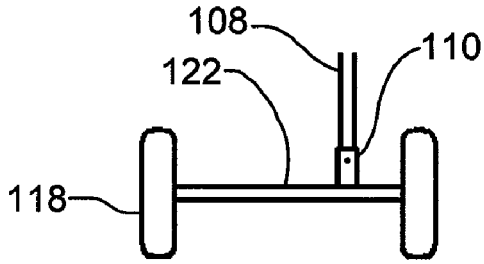
FIG. 12 is a detailed top plan view of an alternative wheel and cross bar.

Referring to FIG. 12, a cross bar 122 is preferably transversely positioned at first end 110 of second body 108. Wheels 118 are mounted at opposed ends of cross bar 112. First end 110 of second body 108 is preferably offset from a center of cross bar 112 to provide a mechanical advantage against torque transmitted from the auger to wheels 118.

Referring to FIG. 10, in a preferred embodiment, the various components are pin connected together to allow stabilizer 100 to be disassembled for storage or transportation. As shown, second body 108 is pin connected to first body 102 at intermediate point 114. Counterweight 116 is positioned on a counterweight holder 124, which is pin connected to second end 106 of first body 102. Referring to FIG. 12, cross bar is pin connected to first end 110 of second body 108. Referring to FIG. 10, handle clamp 120 is pin connected to first end 104 of first body 102.

In addition to allowing stabilizer 100 to be disassembled, the pin connections also allow a tapered pilot hole punch 126 to be included on first body 102, and covered by either handle clamp 120 as shown, or counterweight holder 124 in a different embodiment (not shown). Pilot hole punch 126 is used to start a hole in the ground, prior to using the auger.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. An auger stabilizer, comprising:

a first rigid elongated body having a first end and a second end;

a second rigid elongated body having a first end and a second end, the second body being connected to the first body at a point intermediate the first end and the second end of the first body such that the first end extends outward from the first body;

a counterweight positioned toward the second end of the first body relative to the intermediate point, the counterweight balancing a combined weight of an auger power supply and an auger rotating component of an auger having the auger rotating component depending from the auger power supply;

a pair of spaced apart wheels attached at the first end of the second body; and an attachment configured to pivotally attach the first end of the first body to a one or two man motor driven portable auger, such that when the first end of the body descends, the pair of spaced apart wheels rolls along a ground surface away from the auger, the pair of spaced apart wheels acting to stabilize a handle of the auger against reactive torque.

2. The auger stabilizer of claim 1, wherein a cross bar is transversely positioned at the first end of the second body, the pair of spaced apart wheels being mounted at opposed ends of the cross bar.

3. The auger stabilizer of claim 1, wherein the attachment is a split body that is positionable around a handle of the auger.

4. The auger stabilizer of claim 1, wherein the first body and the second body are comprised of one or more tubular members having a rectangular cross section.

5. The auger stabilizer of claim 1, wherein the second body has a longitudinal axis and is connected to the first body such that the longitudinal axis of the second body is angled away from the auger before the first end of the first body descends, and as the first end of the first body descends, the longitudinal axis of the second body rotates toward a vertical orientation and then past vertical to angle toward the auger.

6. An auger stabilizer, comprising:

a first rigid elongated body having a first end and a second end;

a second rigid elongated body having a first end and a second end, the second body being connected to the first body at a point intermediate the first end and the second end of the first body such that the first end extends outward from the first body;

a counterweight positioned toward the second end of the first body relative to the intermediate point;

a pair of spaced apart wheels attached at the first end of the second body;

a cross bar that is transversely positioned at the first end of the second body, the pair of spaced apart wheels being mounted at opposed ends of the cross bar, wherein the first end of the second body is offset from a center of the cross bar to provide a mechanical advantage against torque transmitted from the auger to the wheels; and an attachment configured to pivotally attach the first end of the first body to a one or two man motor driven portable auger, such that when the first end of the body descends, the pair of spaced apart wheels rolls along a ground surface away from the auger, the pair of spaced apart wheels acting to stabilize a handle of the auger against reactive torque.

7. The auger stabilizer of claim 6, wherein the second body is pin connected to the first body.

8. The auger stabilizer of claim 6, wherein the counterweight is positioned on a counterweight holder, the counterweight holder being pin connected to the second end of the first body.

9. The auger stabilizer of claim 6, wherein the cross bar is pin connected to the first end of the second body.

10. The auger stabilizer of claim 6, wherein the means for pivotally attaching the first end of the first body to the auger is a universal attachment capable of mounting various makes of auger.

11. The auger stabilizer of claim 6, wherein the means for pivotally attaching the first end of the first body to the auger comprises a handle clamp that is pin connected to the first end of the first body.

12. The auger stabilizer of claim 11, wherein the counterweight is greater than the weight of the auger, such that the counterweight raises the auger by force of gravity.

13. The auger stabilizer of claim 6, wherein the counterweight offsets a majority of the weight of the auger.

14. The auger stabilizer of claim 6, wherein the attachment is a split body that is positionable around a handle of the auger.

15. The auger stabilizer of claim 6, wherein the first body and the second body are comprised of one or more tubular members having a rectangular cross section.

16. The auger stabilizer of claim 6, wherein the second body has a longitudinal axis and is connected to the first body such that the longitudinal axis of the second body is angled away from the auger before the first end of the first body descends, and as the first end of the first body descends, the longitudinal axis of the second body rotates toward a vertical orientation and then past vertical to angle toward the auger.

17. An auger stabilizer, comprising:

a first rigid elongated body having a first end and a second end, wherein at least one of the first end and the second end of the first body is a tapered pilot hole punch;

a second rigid elongated body having a first end and a second end, the second body being connected to the first body at a point intermediate the first end and the second end of the first body such that the first end extends outward from the first body;

a counterweight positioned toward the second end of the first body relative to the intermediate point;

a pair of spaced apart wheels attached at the first end of the second body; and an attachment configured to pivotally attach the first end of the first body to a one or two man motor driven portable auger, such that when the first end of the body descends, the pair of spaced apart wheels rolls along a ground surface away from the auger, the pair of spaced apart wheels acting to stabilize a handle of the auger against reactive torque.

18. The auger stabilizer of claim 17, wherein the attachment is a split body that is positionable around a handle of the auger.

19. The auger stabilizer of claim 17, wherein the first body and the second body are comprised of one or more tubular members having a rectangular cross section.

20. The auger stabilizer of claim 17, wherein the second body has a longitudinal axis and is connected to the first body such that the longitudinal axis of the second body is angled away from the auger before the first end of the first body descends, and as the first end of the first body descends, the longitudinal axis of the second body rotates toward a vertical orientation and then past vertical to angle toward the auger.

* * * * *